US008708453B2

(12) United States Patent
Matsumoto et al.

(10) Patent No.: US 8,708,453 B2
(45) **Date of Patent: *Apr. 29, 2014**

(54) CLEANING METHOD AND FLUID EJECTING APPARATUS

(75) Inventors: Daisuke Matsumoto, Matsumoto (JP); Masaru Kobashi, Nagano (JP); Yoichi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 442 days.

This patent is subject to a terminal disclaimer.

(21) Appl. No.: 13/020,744

(22) Filed: Feb. 3, 2011

(65) Prior Publication Data

US 2011/0192913 A1 Aug. 11, 2011

(30) Foreign Application Priority Data

Feb. 5, 2010 (JP) ..... 2010-024817

(51) Int. Cl.
*B41J 2/165* (2006.01)

(52) U.S. Cl.
USPC ..... 347/30

(58) Field of Classification Search
USPC ..... 347/30
See application file for complete search history.

(56) References Cited

U.S. PATENT DOCUMENTS

| | | | | |
|---|---|---|---|---|
| 7,547,097 | B2 | 6/2009 | Tsukada et al. | |
| 2002/0130918 | A1 * | 9/2002 | Hayakawa et al. | 347/29 |
| 2007/0126816 | A1 | 6/2007 | Nishida | |
| 2007/0188538 | A1 | 8/2007 | Izuo | |
| 2007/0252866 | A1 * | 11/2007 | Kudo et al. | 347/30 |
| 2008/0122902 | A1 | 5/2008 | Tanaka et al. | |
| 2009/0179974 | A1 | 7/2009 | Kimura | |

FOREIGN PATENT DOCUMENTS

| | | | |
|---|---|---|---|
| JP | 05-000517 | A | 1/1993 |
| JP | 2004-299292 | A | 10/2004 |
| JP | 2006-137181 | A | 6/2006 |
| JP | 2007-152725 | A | 6/2007 |
| JP | 2007-196442 | A | 8/2007 |
| JP | 2008-126408 | A | 6/2008 |
| JP | 2008-132712 | A | 6/2008 |
| JP | 2009-148928 | A | 7/2009 |

OTHER PUBLICATIONS

Non-Final Office Action of related U.S. Appl. No. 12/890,851(Patent No. 8,449,053), dated Nov. 21, 2012.
Notice of Allowance of related U.S. Appl. No. 12/890,851(Patent No. 8,449,053), dated Mar. 4, 2013.

* cited by examiner

*Primary Examiner* — Justin Seo
(74) *Attorney, Agent, or Firm* — Kilpatrick Townsend & Stockton LLP

(57) ABSTRACT

A method for cleaning a fluid ejecting apparatus is provided. The fluid ejecting apparatus includes a fluid ejecting head that has a plurality of nozzle openings through which fluid is ejected, a fluid supply passage through which the fluid is supplied toward the fluid ejecting head, an open/close valve that is provided on the fluid supply passage, and a pressure reduction mechanism that generates negative pressure in a space outside the nozzle openings. The cleaning method includes a valve-closing operation of putting the open/close valve into a closed state and a pressure reduction operation of generating negative pressure in the space by using the pressure reduction mechanism after the valve-closing operation to cause the fluid to bulge outward at the nozzle openings.

6 Claims, 8 Drawing Sheets

FIG. 9A

| SUCTION AMOUNT Vs (cc) | APPROPRIATE/NOT APPROPRIATE |
|---|---|
| 0.18 > Vs | × |
| 0.18 ≤ Vs ≤ 0.62 | ○ |
| 0.62 < Vs | × |

○ : APPROPRIATE × : NOT APPROPRIATE

FIG. 9B

| | | SUCTION AMOUNT Ts (s) | | |
|---|---|---|---|---|
| | | 0.025 > Ts | 0.025 ≤ Ts ≤ 0.5 | 0.5 < Ts |
| NEGATIVE PRESSURE RELIEF TIME Tn (s) | 0.09 > Tn | × | × | × |
| | 0.09 ≤ Tn ≤ 0.7 | × | ○ | × |
| | 0.7 < Tn | × | × | × |

(0.18 ≤ Vs ≤ 0.62, Ts < Tn)

○ : APPROPRIATE × : NOT APPROPRIATE

CLEANING METHOD AND FLUID EJECTING APPARATUS

BACKGROUND

1. Technical Field

The present invention relates to a cleaning method and a fluid ejecting apparatus.

2. Related Art

An ink-jet printer is widely known as an example of a fluid ejecting apparatus that ejects fluid onto a target medium. An ink-jet printer ejects ink (fluid) onto a target medium through nozzles that are formed in a fluid ejecting head, thereby printing an image on the target medium.

In some cases, a phenomenon of missing dots occurs when such a printer prints an image because of the entering of air into nozzles. To avoid poor printing due to missing dots, some printers of related art carry out cleaning by discharging air bubbles trapped inside nozzles together with ink (for example, refer to JP-A-2007-152725).

Since a large amount of ink is consumed when such cleaning is carried out, in the printer disclosed in JP-A-2007-152725, the amount of ink supplied is changed depending on the level of deterioration in print quality. Even with the ink-supply-amount control disclosed in JP-A-2007-152725, the amount of ink consumed when cleaning is carried out is not small. Therefore, the decreasing of the amount of ink consumed is a problem that has not yet been solved.

SUMMARY

An advantage of some aspects of the invention is to provide a cleaning method and a fluid ejecting apparatus that makes it possible to remove air bubbles without increasing the amount of fluid consumed.

As a first aspect of the invention, the following method for cleaning a fluid ejecting apparatus is provided. The fluid ejecting apparatus includes a fluid ejecting head that has a plurality of nozzle openings through which fluid is ejected, a fluid supply passage through which the fluid is supplied toward the fluid ejecting head, an open/close valve that is provided on the fluid supply passage, and a pressure reduction mechanism that generates negative pressure in a space outside the nozzle openings. The cleaning method according to the first aspect of the invention includes: a valve-closing operation of putting the open/close valve into a closed state; and a pressure reduction operation of generating negative pressure in the space by using the pressure reduction mechanism after the valve-closing operation to cause the fluid to bulge outward at the nozzle openings.

In such a cleaning method, the pressure reduction mechanism generates negative pressure inside the space, which is outside the nozzle openings, thereby causing a part of fluid to bulge outward through the nozzle openings. By this means, it is possible to move air bubbles contained in the fluid with bulges toward the outside of the nozzle openings. In this process, since the open/close valve is in the closed state, no fluid is supplied from the upstream side of the fluid supply passage. Therefore, it is possible to remove air bubbles through the nozzle openings without increasing the amount of fluid consumed.

It is preferable that the cleaning method according to the first aspect of the invention should further include a negative pressure relief operation, wherein the pressure reduction mechanism includes a capping member that is brought into contact with the fluid ejecting head in such a manner that the capping member encloses the nozzle openings to form the space, a sucking section that applies a force of suction to the space, and a negative pressure relief section that relieves the negative pressure in the space; the sucking section should apply the force of suction to the space as the pressure reduction operation; and, after the pressure reduction operation, in the negative pressure relief operation, the negative pressure relief section should relieve the negative pressure in the space in a state in which the open/close valve remains closed and, in addition, the bulges of the fluid are exposed at the nozzle openings.

In such a preferred cleaning method, the negative pressure relief section relieves negative pressure inside the space in the negative pressure relief operation after the pressure reduction operation. Therefore, it is possible to return fluid that is in a bulged state into the fluid ejecting head to avoid wasteful fluid consumption. By this means, it is possible to prevent the destruction of the meniscus of nozzles and to economize ink use.

In the preferred cleaning method described above, the pressure reduction mechanism may include a tube pump that includes a flexible tube and a pressing member; an upstream end of the flexible tube may be connected to the capping member; the pressing member may reciprocate while pressing the tube; the pressing member may move outward from an upstream side of the tube to a downstream side of the tube in the pressure reduction operation; the pressing member may move homeward from the downstream side of the tube to the upstream side of the tube in the negative pressure relief operation; and negative pressure relief time during which the pressing member moves homeward may be longer than pressure reduction time during which the pressing member moves outward.

With such a cleaning method, it is possible to perform suction operation by utilizing the outward movement of the pressing member and to relieve negative pressure generated due to the suction operation by utilizing the homeward movement of the pressing member. The suction operation is performed in a short period of time to ensure that air bubbles move outward easily and thus can be removed efficiently. Since the negative pressure relief time is longer than the suction time, it is possible to prevent the entering of air through the nozzle openings.

In the preferred cleaning method, the negative pressure relief section may be an air open valve through which the space can be communicated with outside air; the air open valve may be in a closed state in the pressure reduction operation; and the air open valve may be in an open state in the negative pressure relief operation.

With such a cleaning method, it is possible to relieve negative pressure inside the space by opening the air open valve.

A fluid ejecting apparatus according to a second aspect of the invention includes: a fluid ejecting head that has a plurality of nozzle openings through which fluid is ejected; a fluid supply passage through which the fluid is supplied toward the fluid ejecting head; an open/close valve that is provided on the fluid supply passage; and a pressure reduction mechanism that generates negative pressure in a space outside the nozzle openings to cause the fluid to bulge outward at the nozzle openings.

Such a fluid ejecting apparatus offers the same advantage as that of the above cleaning method.

BRIEF DESCRIPTION OF THE DRAWINGS

The invention will be described with reference to the accompanying drawings, wherein like numbers reference like elements.

FIG. 9A is a table that shows ranges of suction amount.

FIG. 9B is a table that shows ranges of suction time and negative pressure relief time.

DESCRIPTION OF EXEMPLARY EMBODIMENTS

With reference to FIGS. 1 to 9B, an ink-jet printer according to a first embodiment of the invention, which is a kind of a fluid ejecting apparatus according to an aspect of the invention, will now be explained in detail. An ink-jet printer is hereinafter simply referred to as a printer. The terms "from-back-to-front" direction (or "from-front-to-back" direction when viewed in the reverse orientation), "horizontal direction", and "vertical direction" that appear in the following description of this specification mean the forward/backward (front/back) direction, the leftward/rightward (left/right) direction, and the upward/downward (top/bottom) direction shown by arrows in each of the drawings, respectively.

Figure 1:
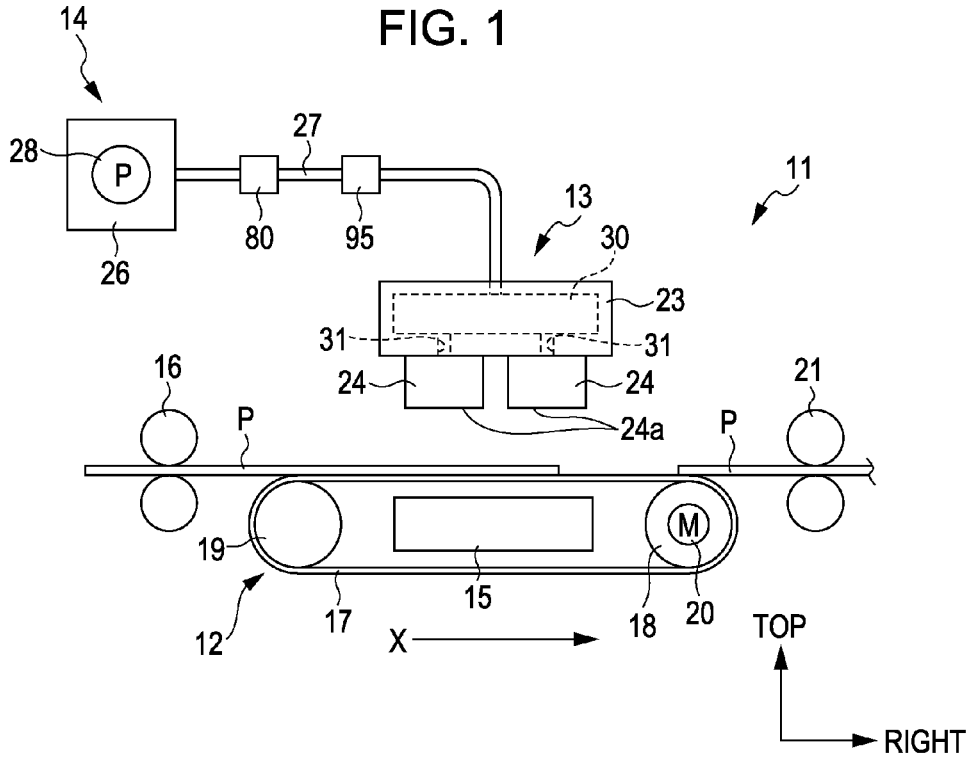
FIG. 1 is a front view that schematically illustrates an example of the structure of an ink-jet printer according to an exemplary embodiment of the invention.

As illustrated in FIG. 1, a printer 11 includes a paper transportation unit 12 that transports a sheet of paper P, which is an example of a print target medium, a line head 13 that performs print processing on the paper P, an ink-supplying unit 14 that supplies ink to the line head 13, and a maintenance unit 15. Ink is an example of fluid according to an aspect of the invention.

The paper transportation unit 12 includes a pair of paper-feed rollers 16, an endless transportation belt (collectively called as "a" belt) 17, a driving roller 18, a driven roller 19, a driving motor 20 that is connected to the driving roller 18, and a pair of paper-eject rollers 21. The transportation belt 17 is stretched between the driving roller 18 and the driven roller 19. The driving roller 18 rotates in a clockwise direction in FIG. 1 when powered by the driving motor 20. The transportation belt 17 runs in a circulatory manner as the driving roller 18 rotates clockwise. The pair of paper-feed rollers 16, transportation belt 17, and the pair of paper-eject rollers 21 transports the paper P in a transportation direction X. The transportation belt 17 is made up of a plurality of belts (e.g., two belts) that supports both of the two edges of the paper P in a paper width direction (from-back-to-front/from-front-to-back direction) Y. The maintenance unit 15 is provided between, for example, the two transportation belts 17 as viewed in this direction.

Figure 2:
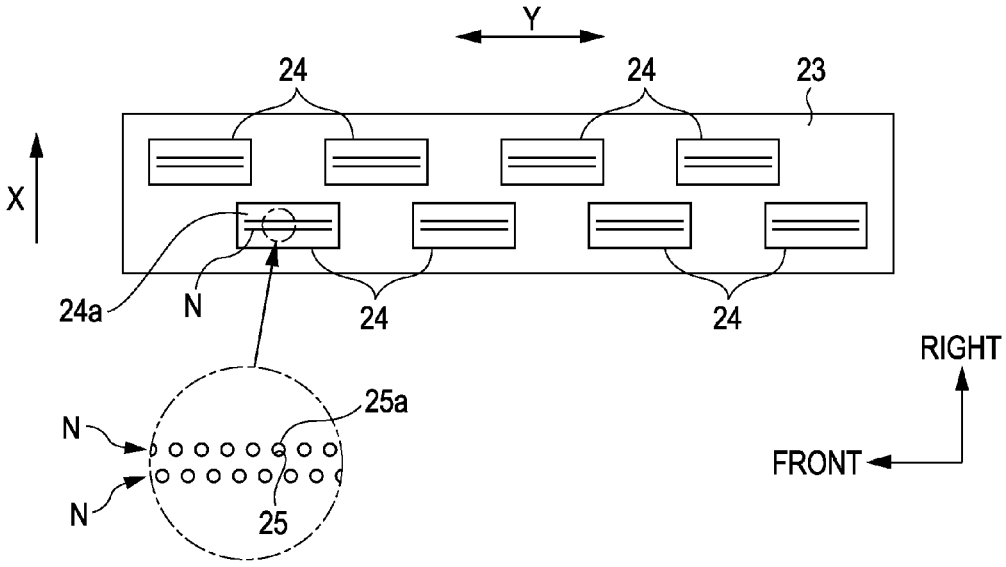
FIG. 2 is a bottom view that schematically illustrates an example of the structure of a line head according to an exemplary embodiment of the invention.

The line head 13 includes a base member 23 and a plurality of fluid ejecting heads 24 fixed to the base member 23. As illustrated in FIG. 2, the fluid ejecting heads 24 are arranged in a staggered pattern. Since the fluid ejecting heads 24 are staggered, there are two rows along the direction of the width Y of the paper P. The first head row, which is located at the upstream side (left side) in the transportation direction X, is made up of four fluid ejecting heads 24 that are arranged next to one another in the width direction Y. The second head row, which is located at the downstream side (right side) in the transportation direction X, is also made up of four fluid ejecting heads 24 that are arranged next to one another in the width direction Y.

A plurality of nozzles 25 from which ink is ejected is formed in each of the plurality of fluid ejecting heads 24. Each of the plurality of fluid ejecting heads 24 has a nozzle formation surface 24*a*, which is the bottom surface thereof. The plurality of nozzles 25 each of which has a nozzle hole 25*a* is formed through the nozzle formation surface 24*a*. The nozzle holes 25*a* are arranged in the width direction Y to make up two nozzle lines N for each of the plurality of fluid ejecting heads 24. As illustrated in the partial enlarged view of FIG. 2, one of the two nozzle lines N is shifted from the other by shift amount equal to a half dot interval in the width direction Y. In other words, the nozzle holes 25*a* are arranged in a staggered pattern with a ½ shift pitch in the width direction Y. For the purpose of explanation, it is assumed here that each of the two nozzle lines N of each of the fluid ejecting heads 24 in the first row were virtually shifted in the transportation direction X to make it in alignment with the corresponding nozzle line N of the fluid ejecting head 24 in the second row or vice versa; under such an assumption, at each "joint", at least one nozzle 25 at an end of the nozzle line N of a fluid ejecting head 24 in the first row would be located at the same position(s) as the position(s) of the nozzle(s) at the end of the nozzle line N of a fluid ejecting head 24 in the second row; alternatively, under the same assumption, at each joint, the nozzle line N of the fluid ejecting head 24 in the first row would be in alignment with the nozzle line N of the fluid ejecting head 24 in the second row with a clearance equal to nozzle pitch between the ends.

Because of the nozzle arrangement explained above, the printer 11 can perform printing at a print area up to the maximum width of a sheet of the paper P without moving the line head 13. In the present embodiment of the invention, the print area of one fluid ejecting head 24 corresponds to a 1.1-inch paper width. Having the eight fluid ejecting heads 24, the line head 13 can cover the width (approximately 8.3 inches) of A4 paper (297 mm in length and 210 mm in width). Each nozzle line N is made up of three hundred and thirty nozzles 25. Therefore, the line head (one line head) 13 has five thousand two hundred and eighty nozzles 25 arranged along the width direction Y, which can be calculated as follows: 8 (the number of the fluid ejecting heads 24)×2 (the number of the nozzle lines N in each of the eight fluid ejecting heads 24)×330 (the number of the nozzles 25 that make up the nozzle line N)=5,280.

In a color printer that performs printing with the use of, for example, four color components of cyan (C), magenta (M), yellow (Y), and black (K), the line head 13 and the ink-supplying unit 14 are provided for each of the four color components (Note that one line head 13 and one ink-supplying unit 14 are illustrated in FIG. 1 for simplicity). The four line heads 13 discharge ink droplets of the respective color components on a sheet of the paper P that is being transported, thereby performing printing with the resolution of 600 dpi.

As illustrated in FIG. 1, the ink-supplying unit 14 includes an ink cartridge 26, an ink supply tube 27, and a pressurizing pump 28. Ink is contained in the ink cartridge 26. Ink is supplied from the ink cartridge 26 to the fluid ejecting heads 24 through the ink supply tube 27. The ink supply tube 27 is an example of a fluid supply passage according to an aspect of the invention. The pressurizing pump 28 is used for pressurization so as to supply ink toward the fluid ejecting heads 24. The ink cartridge 26 is detachably attached to a cartridge holder that is not illustrated in the drawing. The ink supply tube 27 is connected to the ink cartridge 26 through the attachment of the ink cartridge 26 to the cartridge holder. A differential pressure regulating valve 80 and an open/close valve 95 are provided on the ink supply tube 27 between the ink cartridge 26 and the line head 13. The open/close valve 95 is a valve that can open and close the passage arbitrarily. An electromagnetic valve or a mechanical valve can be used as the open/close valve 95.

A common ink chamber 30 is formed inside the base member 23 of the line head 13. Ink supplied from the ink cartridge 26 toward the fluid ejecting heads 24 through the ink supply tube 27 is temporarily retained in the common ink chamber 30. A plurality of branch flow passages 31 that opens into the common ink chamber 30 is formed in the line head 13. Each of the plurality of fluid ejecting heads 24 is in communication with the common ink chamber 30 through the corresponding one of the plurality of branch flow passages 31. The ink retained temporarily in the common ink chamber 30 is supplied to each of the plurality of fluid ejecting heads 24 through the corresponding one of the plurality of branch flow passages 31.

Figure 3:
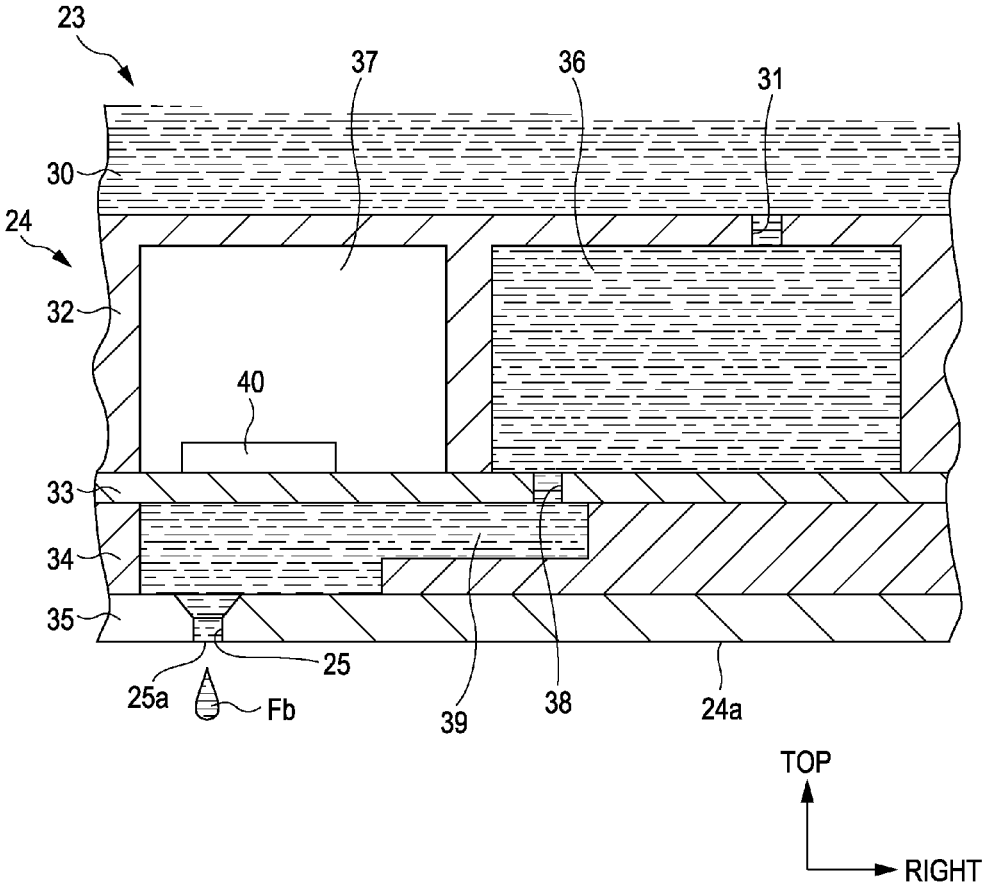
FIG. 3 is a sectional view that schematically illustrates an example of the inner structure of a fluid ejecting head according to an exemplary embodiment of the invention.

As illustrated in FIG. 3, the fluid ejecting head 24 includes a fluid channel formation member 32, a vibrating plate (i.e., diaphragm) 33, a fluid channel formation member 34, and a nozzle plate 35. These components constitute vertical layers. The branch flow passage 31 opening into the common ink chamber 30, a reservoir 36, and a containing chamber 37 are formed in the fluid channel formation member 32. A communication hole 38 is formed through the vibrating plate 33 at a position where a regional part of the reservoir 36 is formed. A cavity 39, which is in communication with the reservoir 36 through the communication hole 38, is formed in the fluid channel formation member 34.

A piezoelectric element 40 is provided on the upper surface of the vibrating plate 33. The piezoelectric element 40 is provided over the cavity 39. The nozzle 25, which opens into the cavity 39, is formed through the nozzle plate 35. The ink distributed from the common ink chamber 30 into each of the fluid ejecting heads 24 through the corresponding branch flow passage 31 is retained in the reservoir 36. The ink is then supplied from the reservoir 36 to each of the plurality of nozzles 25 via the corresponding the communication hole 38 and the corresponding cavity 39.

The vibrating plate 33 is attached between the fluid channel formation members 32 and 34 in such a manner that it can vibrate in the vertical direction. The piezoelectric element 40 stretches and shrinks when it receives a driving signal. The stretching and shrinking of the piezoelectric element 40 causes the vibration of the vibrating plate 33 in the vertical direction. As the vibrating plate 33 vibrates, the capacity of the cavity 39 increases and decreases. As a result of the contraction of the cavity 39, the ink retained in the cavity 39 is ejected through the nozzle 25 in the form of an ink droplet Fb. The lower surface (i.e., bottom surface) of the nozzle plate 35 is the nozzle formation surface 24*a* of the fluid ejecting head 24. In the present embodiment of the invention, the diameter of the nozzle hole 25*a* is approximately 20 μm. The thickness of the nozzle plate 35 in the vertical direction is approximately 100 μm.

Next, the structure of the maintenance unit 15 will now be explained. The maintenance unit 15 includes a capping device 41 (refer to FIG. 4) and a wiping device 42 (refer to FIG. 5). The capping device 41 is used for capping the nozzle formation surface 24*a* of the fluid ejecting head 24. The wiping device 42 is used for wiping the nozzle formation surface 24*a* of the fluid ejecting head 24. The capping device 41 and the wiping device 42 may be provided for each of the plurality of fluid ejecting heads 24. Alternatively, the capping device 41 may cap the plurality of fluid ejecting heads 24 at the same time. The wiping device 42 may wipe the plurality of fluid ejecting heads 24 at the same time.

Besides its capping use for prevention of the drying of the nozzles 25, the capping device 41 is used for suction cleaning. The suction cleaning is a method for forcing out, and thus removing, air bubbles, ink with increased viscosity, or the like by sucking ink from the ink cartridge 26 to the outside through the nozzles 25. Moreover, the capping device 41 is used for receiving ink discharged through the nozzles 25 during pressurization cleaning. The pressurization cleaning is a method for discharging ink through the nozzles 25 by pumping the ink from the ink cartridge 26 thereto. The pressurizing pump 28 is used for the pressurization cleaning. On the other hand, the wiping device 42 is used for wiping the nozzle formation surface 24*a* to remove paper dust, ink, or the like therefrom. In addition, the wiping device 42 is used for arranging the shape of the meniscus of the nozzles 25.

Figure 4:
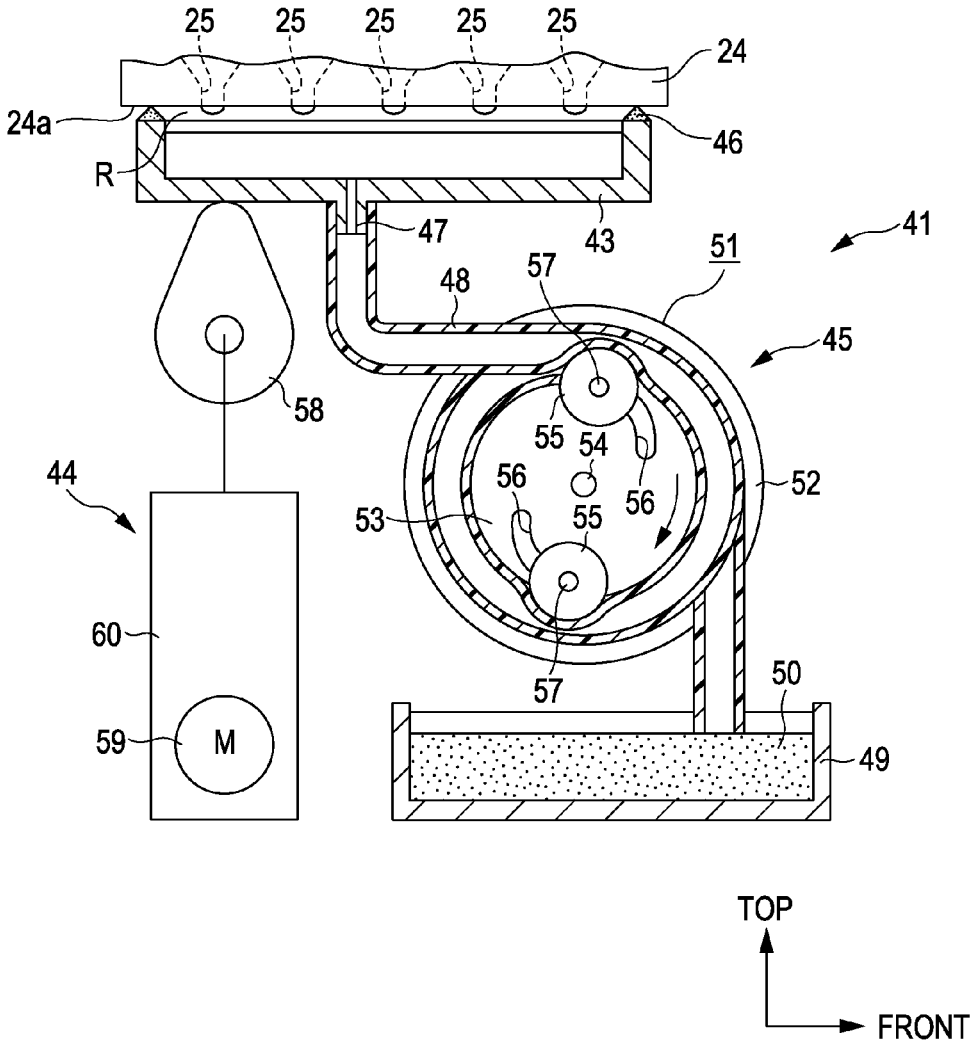
FIG. 4 is a sectional view that schematically illustrates an example of the structure of a capping device according to an exemplary embodiment of the invention.

The structure of the capping device 41 is explained below. As illustrated in FIG. 4, the capping device 41, which is an example of a pressure reduction mechanism according to an aspect of the invention, includes a cap 43 having the shape of an open-topped box, an elevation mechanism 44 that moves the cap 43 up and down, and a suction mechanism 45. The cap 43 is an example of a capping member according to an aspect of the invention. The suction mechanism 45 is an example of a sucking section and a negative pressure relief section according to an aspect of the invention. A sealing member 46, which has the shape of a frame, is provided on the entire upper surface of the sidewalls of the cap 43. The sealing member 46 is made of a flexible material. A drain pipe 47 projects downward from the bottom of the cap 43.

One end (upstream end) of a drain tube 48 is connected to the drain pipe 47. The drain tube 48, which is an example of a tube according to an aspect of the invention, is made of a flexible material. The drain tube 48 is a component of the suction mechanism 45. The other end of the drain tube 48 is inserted in a waste ink tank 49. A waste ink absorber 50 is provided inside the waste ink tank 49. The waste ink absorber 50 is made of a porous material.

A tube pump 51, which is a component of the suction mechanism 45, is provided between the cap 43 and the waste ink tank 49. The tube pump 51 includes a cylindrical case 52, a pump wheel 53, a wheel shaft 54, and a pair of pressing rollers 55. The pump wheel 53 has the shape of a circle in a plan view. The pair of pressing rollers 55 is an example of a pressing member according to an aspect of the invention. The wheel shaft 54 is provided at the center of the case 52. The pump wheel 53 is provided inside the case 52. The pump wheel 53 can rotate around the wheel shaft 54. Excluding its drain-pipe-end part and waste-ink-tank-end part, the drain tube 48 is coiled along the inner circumferential wall of the case 52.

A pair of roller-guide grooves 56 is formed in the pump wheel 53. Each of the pair of roller-guide grooves 56 has the shape of an arc. The positions of these two roller-guide grooves 56 are symmetric with respect to the center of the axle, that is, the wheel shaft 54. One end of each of the pair of roller-guide grooves 56 is located at the inner side of the pump wheel 53. The other end of each of the pair of roller-guide grooves 56 is located at the outer side of the pump wheel 53. In other words, each of the pair of roller-guide grooves 56 is formed in such a manner that the distance between the one end of the roller-guide groove 56 and the wheel shaft 54 is shorter than the distance between the other end of the roller-guide groove 56 and the wheel shaft 54. A rotary shaft 57 is inserted through each of the pair of roller-guide grooves 56. Each of the pair of rotary shafts 57 supports the corresponding one of the pair of pressing rollers 55. Each of the pair of rotary shafts 57 can slide freely along the corresponding one of the pair of roller-guide grooves 56.

When the pump wheel 53 is rotated in the normal direction (which is the clockwise direction shown by an arrow in FIG. 4), each of the pair of pressing rollers 55 moves toward the other end (outer end, that is, toward the outer circumference of the pump wheel 53) of the corresponding one of the pair of roller-guide grooves 56. This movement is hereinafter referred to as outward movement. During the process of the outward movement, the pressing roller 55 rotates while pressing the intermediate region of the drain tube 48 from the upstream side toward the downstream side. As a result of the above rotation, the internal pressure of the drain tube 48 at a region upstream of the tube pump 51 is reduced.

When the pump wheel 53 is rotated in the reverse direction (which is the counterclockwise direction in FIG. 4), each of the pair of pressing rollers 55 moves toward the one end (inner end) of the corresponding one of the pair of roller-guide grooves 56. This movement is hereinafter referred to as "homeward" movement (inward movement). As a result of the homeward movement, each of the pair of pressing rollers 55 is put into a positional state in which it is in contact with the intermediate region of the drain tube 48 while applying slight pressure thereto, which causes the relief of negative pressure inside the drain tube 48.

The elevation mechanism 44 includes a cam member 58 that is in contact with the bottom of the cap 43, a motor 59 that drives the cam member 58, and a power transmission mechanism 60. When the motor 59 rotates in the normal direction, the power of the motor 59 is transmitted to the cam member 58 through the power transmission mechanism 60. The cam member 58 rotates when the motor power is transmitted thereto. The cap 43 is brought into contact with the nozzle formation surface 24*a* when the cam member 58 rotates.

When the pump wheel 53 is rotated in the normal direction in a state in which the sealing member 46 provided on the upper surface of the sidewalls of the cap 43 is in contact with the nozzle formation surface 24*a*, negative pressure is generated in a space R that is enclosed by the cap 43 and the nozzle formation surface 24*a*. The negative pressure is utilized for carrying out suction cleaning for forcing ink out of the nozzles 25. When the pump wheel 53 is rotated in the reverse direction, the negative pressure inside the space R is relieved. The cap 43 is lowered thereafter when the motor 59 of the elevation mechanism 44 rotates in the reverse direction. Therefore, the cap 43 moves away from the path of transportation of the paper P.

When the suction cleaning is carried out with the use of the capping device 41, the tube pump 51 is operated after the closing of the open/close valve 95. In like manner, when the pressurization cleaning is carried out with the use of the capping device 41, the pressurizing pump 28 is operated after the closing of the open/close valve 95. Then, the open/close valve 95 is opened in a state in which pressure inside the ink flow passage has been increased, which increases the velocity of the flow of ink. The increased velocity of the flow of ink makes it possible to effectively force out, and thus remove, air bubbles or the like.

Figure 5:
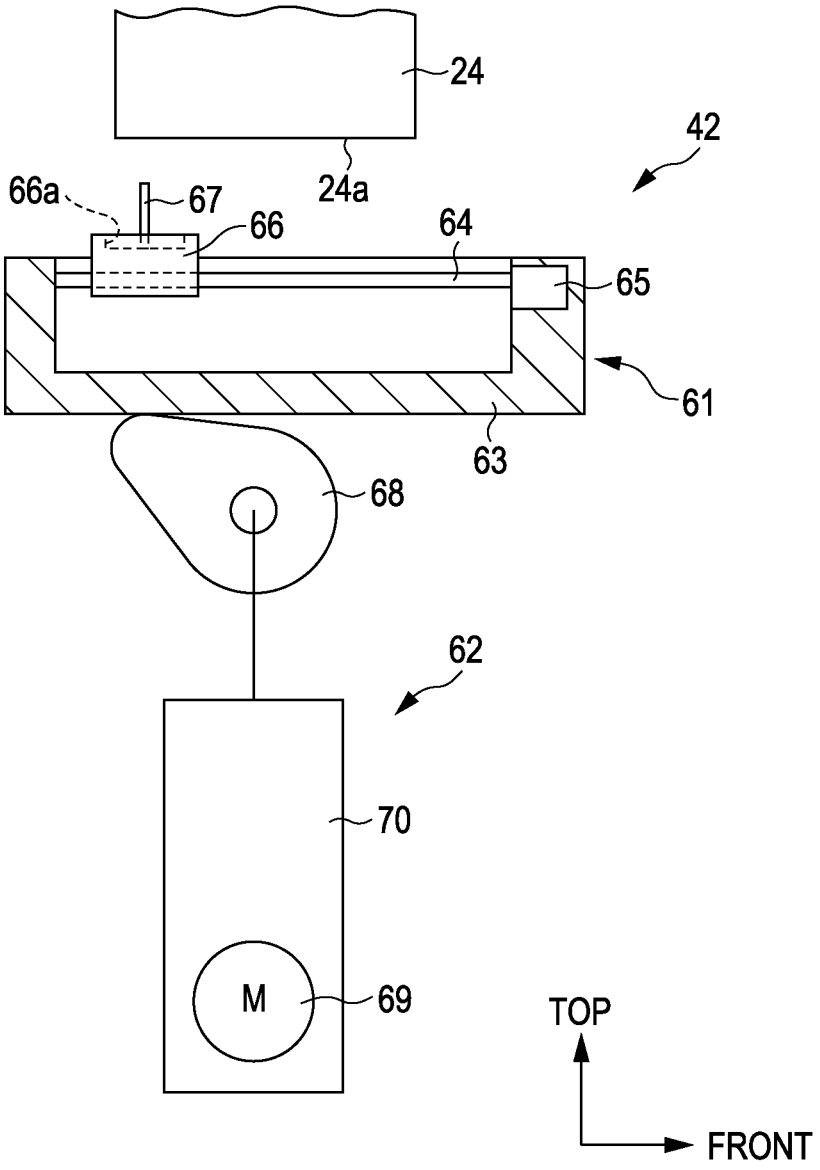
FIG. 5 is a sectional view that schematically illustrates an example of the structure of a wiping device according to an exemplary embodiment of the invention.

Next, the structure of the wiping device 42 will now be explained. As illustrated in FIG. 5, the wiping device 42 includes a wiping mechanism 61 and an elevation mechanism 62. The elevation mechanism 62 moves the wiping mechanism 61 up and down.

The wiping mechanism 61 includes a holder 63, a lead screw 64, a motor 65, a supporting member 66, and a wiper 67. The lead screw 64 is provided on the holder 63 along the "from-back-to-front" direction ("from-front-to-back" direction). The lead screw 64 rotates when driven by the motor 65. The wiper 67 is made of an elastic material such as rubber. The wiper 67 has the shape of a flat plate. The wiper 67 stands upright on the supporting member 66. The supporting member 66 is provided on the lead screw 64. A receiving concave portion 66*a* is formed in the upper surface of the supporting member 66.

The elevation mechanism 62 includes a cam member 68 that is in contact with the bottom of the holder 63 of the wiping mechanism 61, a motor 69 that drives the cam member 68, and a power transmission mechanism 70. When the motor 69 rotates in the normal direction, the power of the motor 69 is transmitted to the cam member 68 through the power transmission mechanism 70. The cam member 68 rotates when the motor power is transmitted thereto. The wiping mechanism 61 is elevated to a position at which the wiper 67 is brought into contact with the nozzle formation surface 24*a* when the cam member 68 rotates.

In addition, when the motor 65 rotates in the normal direction, the lead screw 64 also rotates in the normal direction. As the lead screw 64 rotates, the wiper 67 moves in the "from-back-to-front"/"from-front-to-back" direction together with the supporting member 66. The wiper 67 is in sliding-contact with the nozzle formation surface 24*a* in the process of the movement. As a result, the nozzle formation surface 24*a* is wiped. The wiping device 42 carries out wiping operation in this way. Having been wiped off from the nozzle formation surface 24*a*, ink, paper dust, or the like drops along the wiper 67. The receiving concave portion 66*a* receives the ink, the paper dust, or the like.

Next, the structure of the differential pressure regulating valve 80 will now be explained. In the printer 11, the ink cartridge 26 (cartridge holder that is not illustrated in the drawing) is provided above the line head 13. In order to prevent the dripping of ink from the nozzles 25 and, in addition, to make the ink-ejection operation of the printer 11 stable by forming a concave meniscus in the nozzle 25, the differential pressure regulating valve 80 is used to set the inner pressure of the fluid ejecting head 24 at a negative pressure value of approximately −1 kPa.

Figure 6A:
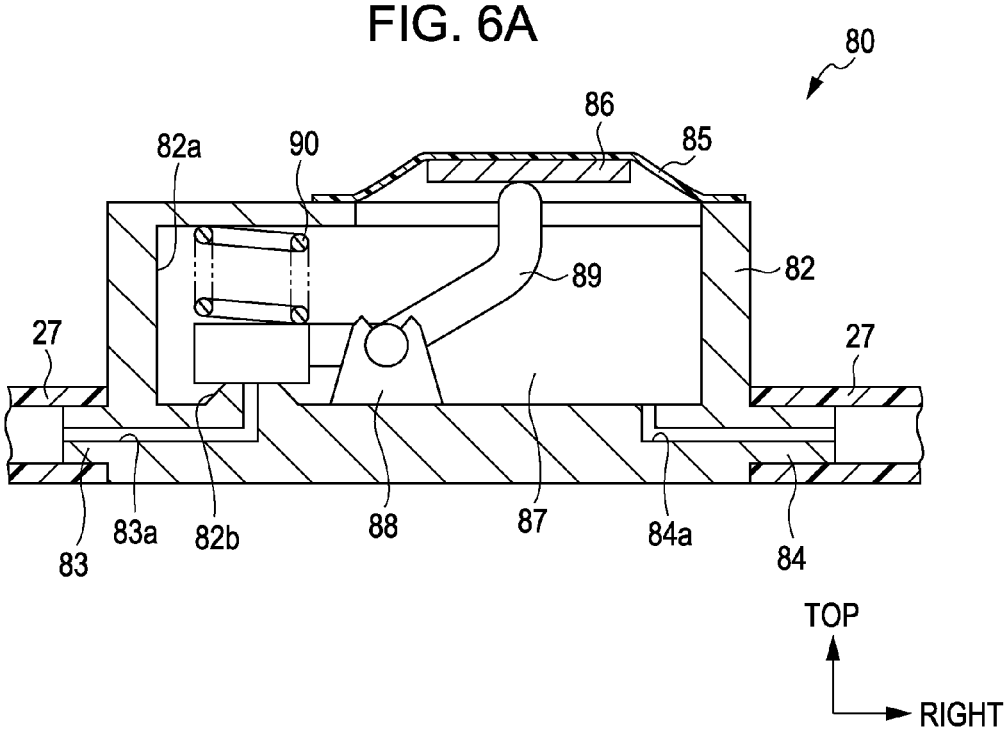
FIG. 6A is a sectional view that schematically illustrates an example of the structure and operation of a differential pressure regulating valve according to an exemplary embodiment of the invention, specifically, the closed state of the valve.

As illustrated in FIG. 6A, the differential pressure regulating valve 80 includes a fluid channel formation member 82 that has a fixed form. A connection portion 83 is formed at the left end of the fluid channel formation member 82. The upstream-side part of the ink supply tube 27 is connected to the connection portion 83. Another connection portion 84 is formed at the right end of the fluid channel formation member 82. The downstream-side part of the ink supply tube 27 is connected to the connection portion 84. A cavity-demarcating inner circumferential wall portion 82*a* is formed above the inner bottom surface of the fluid channel formation member 82. The cavity-demarcating inner circumferential wall portion 82*a* has the shape of a circle in a plan view. A convex portion 82*b* is formed as a raised region of the inner bottom surface of the fluid channel formation member 82. The convex portion 82*b* is formed at an area that is closer to the left than to the right, more specifically, near the left part of the cavity-demarcating inner circumferential wall portion 82*a*. The convex portion 82*b* has the shape of a low-profile truncated cone. An inlet flow passage 83*a* is formed inside the connection portion 83. One end of the inlet flow passage 83*a* is formed as an opening at the top of the convex portion 82*b*. Since the inlet flow passage 83*a* opens into the cavity inside the cavity-demarcating inner circumferential wall portion 82*a*, the upstream-side part of the ink supply tube 27 is in communication with the cavity through the inlet flow passage 83*a*. An outlet flow passage 84*a* is formed inside the connection portion 84. The downstream-side part of the ink supply tube 27 is in communication with the cavity through the outlet flow passage 84*a*.

A film member 85, which is flexible, is bonded to the upper surface of the fluid channel formation member 82 with a moderate slack. The film member 85 seals the opening of the cavity inside the cavity-demarcating inner circumferential wall portion 82*a*. A pressing plate 86 is attached to the inner surface of the film member 85, that is, the surface facing toward the cavity inside the cavity-demarcating inner circumferential wall portion 82*a*, substantially at the center region of the film member 85. The pressing plate 86 has the shape of a disc. The area size of the pressing plate 86 is smaller than the area size of the opening of the cavity inside the cavity-demarcating inner circumferential wall portion 82*a*. An inner space enclosed by the film member 85, the cavity-demarcating inner circumferential wall portion 82*a*, and the inner bottom surface of the fluid channel formation member 82, which is the cavity mentioned above, functions as a pressure chamber 87.

A pedestal portion 88, an arm member 89, and a spring 90 are provided in the pressure chamber 87. The pedestal portion 88 supports the arm member 89 as its base. The arm member 89 can move as an arm that is freely tiltable on the pedestal portion 88. The spring 90 applies an urging force to one end (the left end) of the arm member 89 toward the convex portion 82*b*. Since the urging force of the spring 90 is always applied to the one end of the arm member 89, when in a non-flow stationary state, the one end of the arm member 89 seals the opening of the inlet flow passage 83*a*, which is formed at the top of the convex portion 82*b*. In addition, in this state, the other end (the right end) of the arm member 89 is raised to push up the pressing plate 86. Therefore, in this state, the flexible film member 85 is in a tense position, which is the position of increasing the capacity of the pressure chamber 87, that is, the inner space. Because of the increased capacity of the pressure chamber 87, the inner pressure of the fluid ejecting head 24, which is located downstream of the pressure chamber 87, as well as the inner pressure of the pressure chamber 87 is set at a negative pressure value of approximately −1 kPa.

Figure 6B:
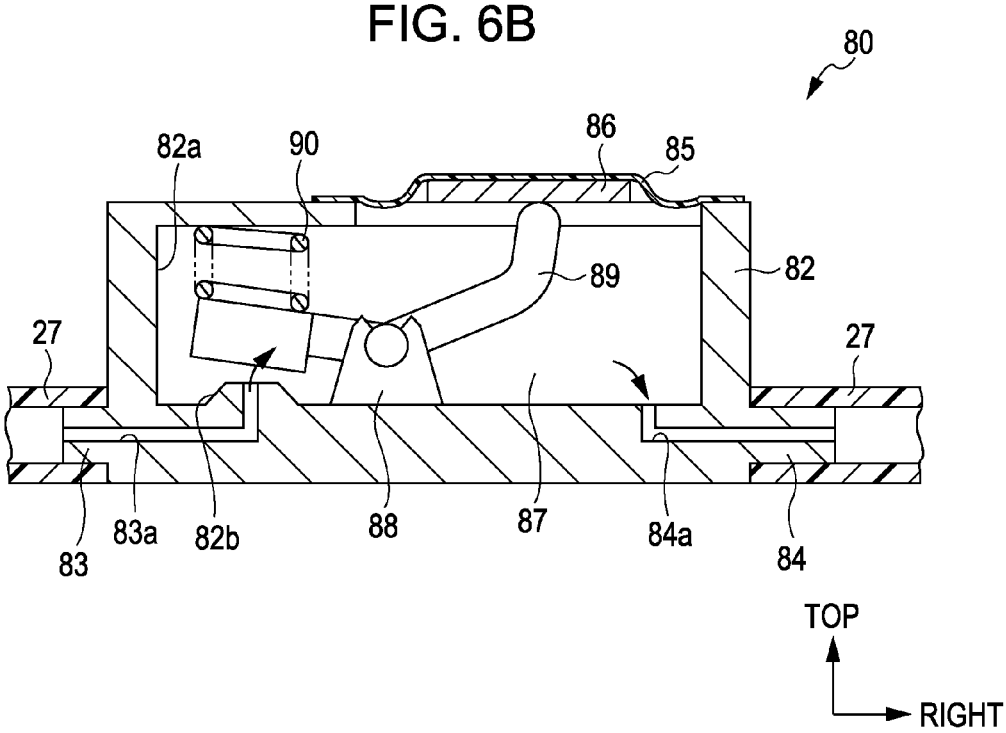
FIG. 6B is a sectional view showing the open state of the valve.

Ink flows into the inlet flow passage 83*a* in a pressurized state due to the operation of the pressurizing pump 28. The one end of the arm member 89, which the urging force of the spring 90 is always applied to, functions as a stopper that prevents the ink from flowing into the pressure chamber 87. When ink is consumed due to ejection, discharging, drainage, or the like through the nozzles 25, negative pressure inside the pressure chamber 87 increases. As a result, as illustrated in FIG. 6B, the flexible film member 85 becomes deformed in the direction of decreasing the capacity of the pressure chamber 87. The film member 85 indirectly applies a pressing force to the other end of the arm member 89 through the pressing plate 86. Because of the pressing force, the arm member 89 turns. Since the one end of the arm member 89 is raised, the opening of the inlet flow passage 83*a* is unsealed. As a result, the pressurized ink flows into the pressure chamber 87.

Since the ink flows into the pressure chamber 87, negative pressure inside the pressure chamber 87 decreases. Each of the arm member 89 and the film member 85 returns to its original position due to the urging force of the spring 90. In this way, ink whose amount of supply corresponds to the amount of consumption is supplied to the fluid ejecting head 24.

Next, the maintenance operation of the printer 11 will now be explained. It is known that a missing-dot phenomenon or a clogged-nozzle phenomenon sometimes occurs. Specifically, the missing-dot phenomenon occurs because of the entering of air, which forms into air bubbles, into the ink supply tube 27 at the time of replacement of the ink cartridges 26 detachably mounted on the printer 11. The viscosity of ink increases during a period of time in which the printer 11 is out of use. For example, if the power of the printer 11 has not been turned on for a long period of time, ink with increased viscosity could have caused the clogging of the nozzles 25. To avoid deterioration in quality that is ascribable to such a missing-dot phenomenon or a clogged-nozzle phenomenon, the printer 11 carries out suction cleaning or pressurization cleaning with the use of the capping device 41. Cleaning that is carried out by draining ink out of the nozzles 25 while supplying ink from the ink cartridge 26 is hereinafter referred to as "ink-supply cleaning".

Paper dust or the like sometimes sticks to the nozzle formation surface 24*a* in the process of printing. In such a case, the nozzle formation surface 24*a* is wiped with the use of the wiping device 42 to remove the paper dust or the like therefrom. When the ink-supply cleaning is carried out, drained ink sometimes sticks to the nozzle formation surface 24*a*. A convex meniscus sometimes forms in the nozzle hole 25*a*. Therefore, wiping operation is performed immediately after the completion of the ink-supply cleaning, too.

However, when wiping operation is performed, the wiper 67 sometimes forces air into the nozzles 25, thereby producing very small air bubbles inside the nozzles 25. Such an air bubble is much smaller than an air bubble produced due to the entering of air at the time of cartridge replacement. In many cases, air bubbles are trapped in the neighborhood of the nozzles 25. To remove very small air bubbles trapped in the neighborhood of the nozzles 25, the printer 11 carries out "cleaning without supplying ink" (hereinafter referred to as "non-ink-supply cleaning") with the use of the capping device 41 and the open/close valve 95.

Next, the non-ink-supply cleaning with the use of the capping device 41 and the open/close valve 95 will now be explained in detail. The non-ink-supply cleaning includes a valve-closing step of putting the open/close valve 95 into a closed state, a pressure reduction step of generating negative pressure in the space R with the use of the capping device 41 after the valve-closing step to form a bulge of ink at each of the nozzles 25, and a negative pressure relief step of relieving the negative pressure inside the space R.

Figure 7A:
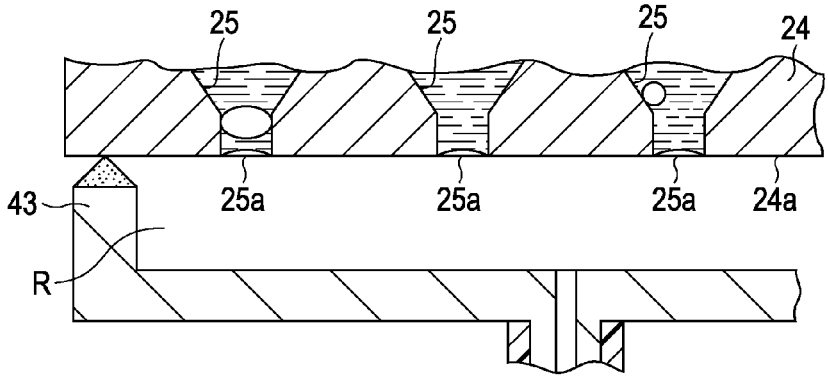
FIG. 7A is a sectional view that schematically illustrates an example of non-ink-supply cleaning according to an exemplary embodiment of the invention, specifically, a state before suction.
Figure 7B:
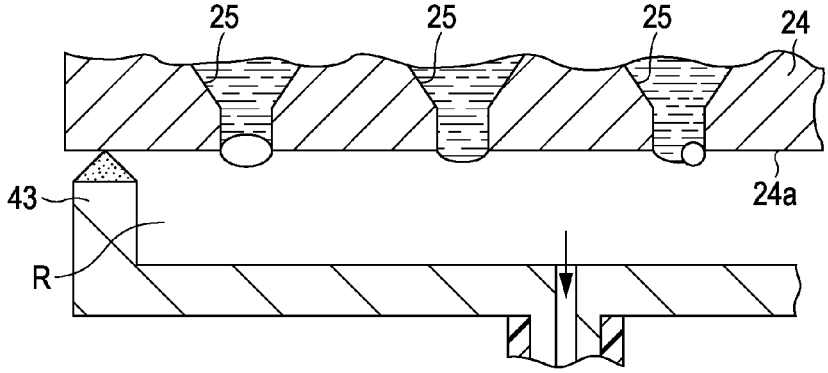
FIG. 7B is a sectional view showing a state at the time of suction.

In the pressure reduction step, in a state in which the sealing member 46 provided on the upper surface of the sidewalls of the cap 43 is in contact with the nozzle formation surface 24*a*, the pressing roller 55 of the tube pump 51 moves from the upstream side of the drain tube 48 toward the downstream side thereof, which is the aforementioned outward movement. Therefore, air in the space R is sucked. In order to ensure that ink is not sucked out through the nozzle, in this process, the distance of the movement of the pressing roller 55 is set shorter than movement distance for suction cleaning. In addition, the pressing roller 55 is moved at a relatively high speed so that air bubbles come off from the inner wall of the nozzles 25 as illustrated in FIG. 7A. Then, the force of suction is utilized to cause a part of ink to bulge outward at the nozzles 25 as illustrated in FIGS. 4 and 7B, thereby causing the air bubbles to move to the pressure-reduced-space side, that is, toward the outside of the nozzle holes 25*a*. The ink inside the nozzles 25 is in a moderately pressure-reduced state so that the ink is not sucked out through the nozzle holes 25.

Figure 7C:
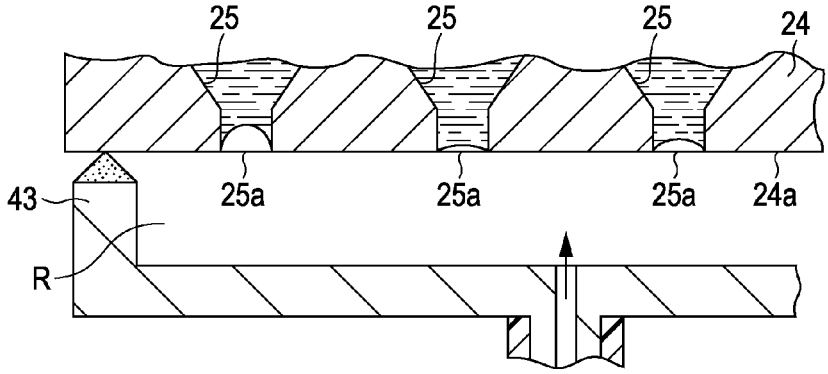
FIG. 7C is a sectional view showing a state at the time of negative pressure relief.
Figure 7D:
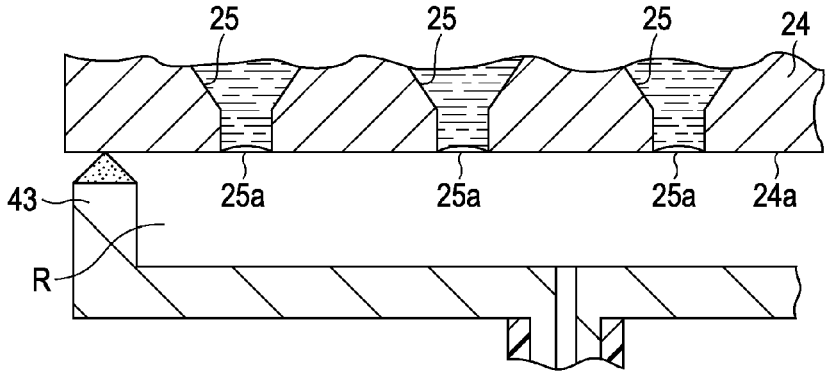
FIG. 7D is a sectional view showing a state after still standing.

After the pressure reduction step, in the negative pressure relief step, the pressing roller 55 of the tube pump 51 moves from the downstream side of the drain tube 48 toward the upstream side thereof, which is the aforementioned homeward movement, in a state in which the open/close valve 95 remains closed and, in addition, the bulges of the ink are exposed at the nozzles 25. As a result of the homeward movement, the sucked air is returned into the space R, thereby relieving the negative pressure inside the space R. Since the ink with the bulges (convex meniscuses) recedes into the nozzles 25 because of the relieving of the negative pressure as illustrated in FIG. 7C, the ink is not ejected in the form of ink droplets Fb. When an air bubble is removed, a space whose capacity is equal to the capacity of the air bubble is formed inside the nozzle 25. However, as illustrated in FIG. 7D, when left to stand, ink retained in the common ink chamber 30 is replenished into the nozzle 25 due to a capillary force. The open/close valve 95 is opened after the negative pressure relief step to end the non-ink-supply cleaning.

In the non-ink-supply cleaning, the suction operation and the negative pressure relief operation may be repeated more than once. By this means, even when there are some air bubbles that are hard to come off, it is possible to gradually move such air bubbles outward. In addition, even when there are spaces in some nozzles 25 because of the removal of air bubbles therefrom, the surface of ink at all of the nozzles 25 is made level gradually in the course of the repetition of suction operation and negative pressure relief operation.

Figure 8:
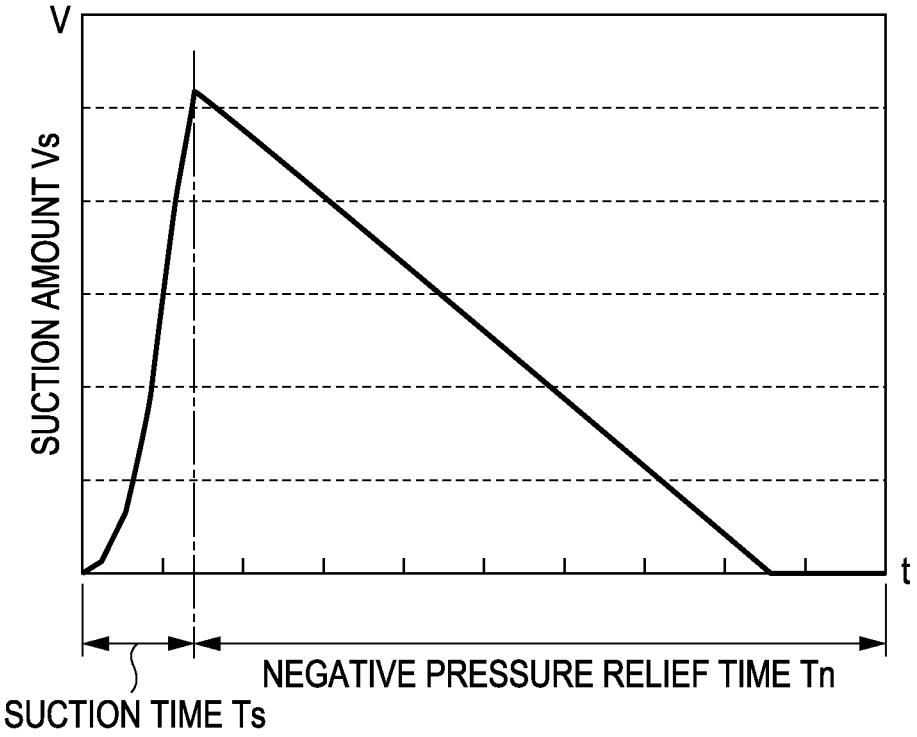
FIG. 8 is a graph that shows relationship between suction time and negative pressure relief time.

As illustrated in FIG. 8, it is preferable that negative pressure relief time Tn, which is the length of time during which negative pressure is relieved in the negative pressure relief step, should be set longer than suction time (pressure reduction time) Ts, which is the length of time during which suction (pressure reduction) operation is performed in the pressure reduction step. Specifically, the length of time during which each of the pair of pressing rollers 55 of the tube pump 51 moves toward the other end of the corresponding one of the pair of roller-guide grooves 56 while pressing the intermediate region of the drain tube 48, that is, the outward movement, is set shorter than the length of time during which each of the pair of pressing rollers 55 of the tube pump 51 moves toward the one end of the corresponding one of the pair of roller-guide grooves 56, that is, the homeward movement.

Assuming that the amount of suction is constant, if the suction time Ts is too short, the velocity of the flow of ink is too high. Because of the excessively fast flow of ink, there is a possibility that ink will be ejected from the nozzles 25 when it is not supposed to, resulting in wasteful ink consumption. In addition, if the suction time Ts is too short, there is a possibility that negative pressure relief operation will be started at a too early point in time. If negative pressure relief operation is started too early, there is a possibility that ink with bulges recedes into the nozzles 25 before air bubbles move to the pressure-reduced-space side completely. If the suction time Ts is too long, the velocity of the flow of ink is too low. Because of the excessively slow flow of ink, there is a possibility that air bubbles do not come off from the inner wall of the nozzles 25. In addition, if the suction time Ts is too long, there is a possibility that negative pressure relief operation will be started at a too late point in time. In such a case, since ink will not be returned in time, there is a possibility of wasteful ink consumption.

On the other hand, if the negative pressure relief time Tn is too long, there is a possibility that ink will not be returned in time, resulting in wasteful ink consumption. In addition, it takes time to remove air bubbles and restore meniscus. If the negative pressure relief time Tn is too short, there is a possibility that air bubbles will form due to the entering of air through the nozzles 25.

The appropriate length of suction time for moving air bubbles outward for successful removal while avoiding ink from being ejected wastefully is very short, for example, from 0.025 to 0.5 seconds. If negative pressure were released in such a short period of time, air would enter. To avoid the entering of air, when the suction time Ts is set in a range from 0.025 to 0.5 seconds, it is preferable that the suction time Ts and the negative pressure relief time Tn should have the following relationship: the suction time Ts<the negative pressure relief time Tn.

In the present embodiment of the invention, when the non-ink-supply cleaning is carried out, the pressure inside the space R is reduced moderately so that ink is not ejected through the nozzles 25. An appropriate range for each of the amount of suction of air Vs in the suction step, the suction time Ts, and the negative pressure relief time Tn will now be explained.

As illustrated in FIG. 9A, it is preferable that the suction amount Vs should be set in the following range: 0.18 cc≤Vs≤0.62 cc. If the suction amount is smaller than 0.18 cc (0.18 cc>Vs), there is a possibility that a force of suction that is strong enough to move air bubbles outward for successful removal is not obtained. If the suction amount is larger than 0.62 cc (0.62 cc<Vs), there is a possibility that ink will be consumed when it is not supposed to. Since each line head 13 has five thousand two hundred and eighty nozzles 25, a preferred range of the bulging of ink per nozzle is approximately from $3.5\times10^{-5}$ cc to $11.7\times10^{-5}$ cc.

When the suction amount Vs is set in the range from 0.18 cc inclusive to 0.62 cc inclusive, it is preferable that the suction time Ts should be set in the following range: 0.025 seconds≤Ta≤0.5 seconds. In addition, when the suction amount Vs is set in the above range, the negative pressure relief time Tn should be set in the following range: 0.09 seconds≤Td≤0.7 seconds (where Ta<Td). Empirical data shows that optimum results can be obtained under the following conditions: Vs (suction amount)=0.33 cc, Ts (suction time)=0.15 seconds, and Tn (negative pressure relief time) =0.35 seconds.

When the non-ink-supply cleaning is carried out, ink does not stick to the nozzle formation surface 24*a*. In addition, it is possible to arrange the shape of the meniscus of the nozzles 25. Therefore, unlike the ink-supply cleaning, it is not necessary to perform wiping operation immediately after the completion of the non-ink-supply cleaning. Moreover, it is possible to reduce the amount of consumption of ink to almost zero. Furthermore, the cleaning can be carried out in a very short period of time.

The present embodiment of the invention explained above offers the following advantages.

(1) The capping device 41 generates negative pressure inside the space R, which is outside the nozzle holes 25*a*, thereby causing a part of ink to bulge outward at the nozzles 25. By this means, it is possible to move air bubbles contained in the ink with bulges to the pressure-reduced-space side, that is, toward the outside of the nozzle holes 25*a*. In this process, since the open/close valve 95 is in a closed state, no ink is supplied from the ink cartridge 26, which is located upstream of the ink supply tube 27. Therefore, it is possible to remove air bubbles through the nozzles 25 without increasing the amount of ink consumed.

(2) The negative pressure relief section relieves negative pressure inside the space R in the negative pressure relief step after the pressure reduction step. Therefore, it is possible to return ink that is in a bulged state into the fluid ejecting head 24 to avoid wasteful ink consumption. By this means, it is possible to prevent the destruction of the meniscus of the nozzles 25 and to economize ink use.

(3) It is possible to perform suction operation by utilizing the outward movement of the pair of pressing rollers 55 of the tube pump 51. It is possible to relieve negative pressure generated due to the suction operation by utilizing the homeward movement of the pair of pressing rollers 55 of the tube pump 51. The suction operation is performed in a short period of time to ensure that air bubbles move outward easily and thus can be removed efficiently. Since the negative pressure relief time Tn is longer than the suction time Ts, it is possible to prevent the entering of air through the nozzle holes 25*a*.

(4) Since the common ink chamber 30 adjusts the back pressure of the nozzles 25, it is possible to make the meniscus of all of the nozzles 25 uniform. Therefore, even when there is a space in a certain nozzle 25 because of the removal of an air bubble therefrom, the surface of ink at the nozzle 25 is made level with the surface of ink at the other nozzles 25.

The foregoing exemplary embodiment of the invention may be modified as follows.

An air open valve through which the space R can be opened to the outside for ventilation may be formed in the cap 43. The air open valve functions as the negative pressure relief section. In such a modified structure, the air open valve is in a closed state in the pressure reduction step. The air open valve is in an open state in the negative pressure relief step. With such a modified structure, it is possible to relieve negative pressure inside the space R by opening the air open valve.

Any alternative means that can generate negative pressure may be used as the sucking section. For example, a piston pump or a diaphragm pump may be used in place of the tube pump 51.

The differential pressure regulating valve 80 may be omitted. In such a modified structure, the ink cartridge 26 (cartridge holder that is not illustrated in the drawing) is provided below the line head 13. Since there is a water head difference therebetween, it is possible to make the inner pressure of the fluid ejecting head 24 negative.

The common ink chamber 30 may be omitted as in the following example. One end (base end) of the ink supply tube 27 is connected to the ink cartridge 26. The other end (front end) of the ink supply tube 27 has a branched structure. Each of the plurality of branches of the ink supply tube 27 is connected to the corresponding one of the plurality of fluid ejecting heads 24.

The fluid supply passage may be a rigid pipe member or the like that is not flexible.

When the diameter of the nozzle and/or fluid that is ejected is/are changed, a frictional resistance, viscosity, etc. changes. Therefore, in such a case, it is preferable to modify each of the suction amount Vs, the suction time Ts, and the negative pressure relief time Tn into an appropriate value.

The number of the fluid ejecting heads 24, the number of the nozzles 25, and the number of the nozzle lines N can be modified arbitrarily.

A non-detachable ink tank may be used as a fluid container.

A fluid ejecting apparatus according to an aspect of the invention may be embodied as a full-line-type line head printer that has an elongated fluid ejecting head.

In the description of the foregoing embodiment of the invention, an ink-jet printer is taken as an example of a fluid ejecting apparatus. However, the scope of the invention is not limited to an ink-jet printer. The invention can be applied to various fluid ejecting apparatuses that eject or discharge various kinds of fluid that include ink but not limited thereto. It can be applied to various micro-droplet liquid ejecting apparatuses that are provided with micro-droplet liquid ejecting heads for discharging liquid droplets whose amount is very small. Herein, a "liquid droplet" is a form or a state of liquid in the process of ejection of the liquid from a liquid ejecting apparatus. The liquid droplet encompasses, for example, a particulate droplet, a tear-shaped droplet, and a viscous/thready droplet that forms a thread tail, without any limitation thereto. The "liquid" may be made of any material as long as a liquid ejecting apparatus can eject it. The liquid may be any substance as long as it is in a liquid phase. It may have high viscosity or low viscosity. It may be sol or gel water. Alternatively, it may be fluid that includes, without any limitation thereto, inorganic solvent, organic solvent, solution, liquid resin, and liquid metal (e.g., metal melt). The "liquid" is not limited to liquid as a state of a substance. It encompasses a liquid/liquefied matter/material that is made as a result of dissolution, dispersion, or mixture of particles of a functional material made of a solid such as pigment, metal particles, or the like into/with a solvent, though not limited thereto. Besides ink explained in the foregoing exemplary embodiment, liquid crystal is a typical example of the liquid. The term "ink" encompasses various types of ink having various liquid compositions such as popular water-based ink, oil-based ink, gel ink, hot melt ink, or the like. Examples of various liquid ejecting apparatuses are: an apparatus that ejects liquid in which, for example, a material such as an electrode material, a color material, or the like that is used in the production of a liquid crystal display device, an organic EL (electroluminescence) display device, a surface/plane emission display device, a color filter, or the like is dispersed or dissolved, an apparatus that ejects a living organic material that is used for production of biochips, an apparatus that is used as a high precision pipette and ejects liquid as a sample, a textile printing apparatus, a micro dispenser, and the like. In addition, the invention is applicable to a liquid ejecting apparatus that ejects, with high precision, lubricating oil onto a precision instrument and equipment including but not limited to a watch and a camera. Moreover, the invention is applicable to a liquid ejecting apparatus that ejects liquid of a transparent resin such as an ultraviolet ray curing resin or the like onto a substrate so as to form a micro hemispherical lens (optical lens) that is used in an optical communication element or the like. Furthermore, the invention is applicable to a liquid ejecting apparatus that ejects an etchant such as acid or alkali that is used for the etching of a substrate or the like. Without any intention to limit the technical scope of the invention to those enumerated or explained above, the invention can be applied to various ejecting apparatuses that eject or discharge various kinds of fluid such as those enumerated or explained above.

The entire disclosure of Japanese Patent Application No. 2010-024817, filed Feb. 5, 2010 is expressly incorporated by reference herein.

What is claimed is:

1. A method for cleaning a fluid ejecting apparatus including a fluid ejecting head that has a plurality of nozzle openings through which fluid is ejected, a fluid supply passage through which the fluid is supplied toward the fluid ejecting head, an open/close valve that is provided on the fluid supply passage, and a pressure reduction mechanism that generates negative pressure in a space outside the nozzle openings, the cleaning method comprising:

a valve-closing operation of putting the open/close valve into a closed state;

a pressure reduction operation of generating negative pressure in the space by using the pressure reduction mechanism after the valve-closing operation to cause the fluid to bulge outward at the nozzle openings; and a negative pressure relief operation, wherein the pressure reduction mechanism includes a capping member that is brought into contact with the fluid ejecting head in such a manner that the capping member encloses the nozzle openings to form the space, a sucking section that applies a force of suction to the space, and a negative pressure relief section that relieves the negative pressure in the space; wherein the sucking section applies the force of suction to the space as the pressure reduction operation; and wherein after the pressure reduction operation, in the negative pressure relief operation, the negative pressure relief section relieves the negative pressure in the space in a state in which the open/close valve remains closed and, in addition, the bulges of the fluid are exposed at the nozzle openings, further wherein the pressure reduction mechanism includes a tube pump that includes a flexible tube and a pressing member; an upstream end of the flexible tube is connected to the capping member; the pressing member reciprocates while pressing the tube; the pressing member moves outward from an upstream side of the tube to a downstream side of the tube in the pressure reduction operation; the pressing member moves homeward from the downstream side of the tube to the upstream side of the tube in the negative pressure relief operation; and negative pressure relief time during which the pressing member moves homeward is longer than pressure reduction time during which the pressing member moves outward.

2. The cleaning method according to claim 1, wherein the negative pressure relief section is an air open valve through which the space can be communicated with outside air; the air open valve is in a closed state in the pressure reduction operation; and the air open valve is in an open state in the negative pressure relief operation.

3. The cleaning method according to claim 1, wherein pressure reduction time is between 0.025 seconds and 0.5 seconds.

4. The cleaning method according to claim 1, wherein pressure reduction time is 0.15 seconds.

5. The cleaning method according to claim 1, wherein negative pressure relief time is between 0.09 seconds and 0.7 seconds.

6. The cleaning method according to claim 1, wherein negative pressure relief time is 0.35 seconds.

* * * * *